US005511781A

United States Patent [19]

Wood et al.

[11] Patent Number: 5,511,781

[45] Date of Patent: Apr. 30, 1996

[54] STOP PLAY AWARD WAGERING SYSTEM

[75] Inventors: Michael W. Wood, Denham Springs, La.; Hugh J. Shaddick, Henderson; Richard S. Schneider, Las Vegas, both of Nev.

[73] Assignee: United Games, Inc., Las Vegas, Nev.

[21] Appl. No.: 18,953

[22] Filed: Feb. 17, 1993

[51] Int. Cl.[6] ..... A63F 1/00

[52] U.S. Cl. ..... 273/85 CP; 273/138 A; 273/292; 364/412

[58] Field of Search ..... 273/138 A, 138 R, 273/143 R, 85 CP, 292; 364/412

[56] References Cited

U.S. PATENT DOCUMENTS

| | | | |
|---|---|---|---|
| 4,743,022 | 5/1988 | Wood | 273/85 CP |
| 4,836,546 | 6/1989 | DiRe et al. | 273/138 A |
| 5,022,653 | 6/1991 | Suttle et al. | 273/85 CP |
| 5,033,744 | 7/1991 | Bridgeman et al. | 273/85 CP |
| 5,042,818 | 8/1991 | Weingardt | 273/85 CP |
| 5,046,735 | 9/1991 | Hamano et al. | 273/138 A |
| 5,108,099 | 4/1992 | Smyth | 273/138 A |
| 5,167,413 | 12/1992 | Fulton | 273/85 CP |
| 5,169,147 | 12/1992 | Hamano | 273/138 A |
| 5,225,915 | 10/1993 | Miller | 273/85 CD |
| 5,259,616 | 11/1993 | Bergmann | 273/138 A |
| 5,269,521 | 12/1993 | Rossides | 273/138 A |

*Primary Examiner*—Vincent Millin

*Assistant Examiner*—Kerry Owens

*Attorney, Agent, or Firm*—Knobbe, Martens, Olson & Bear

[57] ABSTRACT

A system is adaptable to any game where a player sequentially receives a number of elements having identifying characteristics, with certain combinations of elements defined to be winning combinations. After all or part of an initial set of elements is obtained, the system offers the player an award to stop play prior to receiving a final set of elements. The amount of the offer is preferably based, at least in part, upon the probabilities of obtaining a winning combination using the initial set of elements received by the player. In accepting the "stop play" offer, the play of the game may cease, with the player forfeiting the right to win an award based on the final winning combinations, or, in an alternate embodiment, play can continue with an award, if any, based upon a modified pay schedule. In one embodiment, a standard video poker game is modified whereby upon receiving the initial set of five cards, an expected (winning) value for those cards is calculated based upon a summation of the awards and probabilities associated with every available discard and draw combination. Prior to permitting discards and further draws, an offer is made to the player based upon this calculated value. If the award is accepted, several playing options can be made available, such as terminating play, continuing play to show the optimum strategy and the result that would have been thereby obtained, or continuing play using a modified award schedule.

62 Claims, 8 Drawing Sheets

100
START
102
SHUFFLE DECK
104
PLAYER SIGNALS FOR A NEW HAND ?
NO
YES
106
DEAL CARDS AND BEGIN DISPLAY SEQUENCE
108
BUILD MESSAGE OF PAYTABLE TYPE STARTING HAND, AND PROGRESSIVE JACKPOT AMOUNTS
110
SEND MESSAGE, RELOAD AND START TIMER, WAIT FOR ACK
112
TIMER ZERO ?
YES
NO
114
INCREMENT RETRY COUNTER
116
TOO MANY RETRIES ?
NO
YES
120
REVERT TO ERROR CONDITION
122
NACK ?
YES
NO
124
VALID ACK ?
NO
YES

STOP PLAY AWARD WAGERING SYSTEM

FIELD OF THE INVENTION

The present invention relates generally to wagering and gaming devices and, more particularly, is concerned with improvements to existing games and gaming devices to include more opportunities for player choices during each round of the game by offering the player an award as an inducement to complete play prior to the end of the round.

BACKGROUND OF THE INVENTION

Operators of wagering games are continually seeking new game ideas which provide wide player popularity to promote greater player enjoyment, increased volume of play, and ultimately, higher revenues from their gaming operations. Study of existing successful games (5 card draw poker, keno, "21", etc.) shows that they usually include many of some general characteristics, including the following:

- An underlying game concept which is easily understood and has wide recognition in our society, e.g. by basing a game on combinations of cards drawn from a deck of playing cards, with graduated award levels assigned to common poker hands (pairs, two pairs, straights, flushes, etc.), wide public recognition of the game is achieved. The structure of a deck of cards is well known, as are the basics regarding the identity of winning poker hands and the relative difficulty associated with attaining each hand;
- The rules of the game are simple and can be explained in just a few short sentences to an average member of the general populace;
- The game involves one or more simple decisions (other than deciding on the wager amount) to provide the player with a feeling that he has some influence on the final outcome of the game;
- The game is fair, e.g., in a dice game the player must feel confident that each of the six possible outcomes of the die roll are equally likely;
- The game must provide a high success rate, in other words, the ratio of winning rounds to total rounds played (commonly referred to as hit frequency) should be a high number;
- The player must feel that during any one extended play session or round there is a reasonable chance of winning more than what is being risked in order to play the game.

In addition to these requirements, a practical game must, on average, provide both the players and the game operator with a predictable share of all moneys wagered which are within acceptable statistical limits governed by the laws of probability. The share of moneys wagered which is kept by the game operator must provide sufficient revenue to cover overhead costs and provide the expected rate of return on the resources invested for development of the gaming operation. The operators share, when expressed as a percentage of total moneys wagered, is referred to as the "hold percentage." In precise mathematical terms the hold percentage is the Mathematical Expectation (also referred to as the Expected Value) of the percentage of moneys wagered that is kept by the game.

The percentage of moneys wagered that is paid out to players in the form of awards is referred to as the "payback percentage." The payback percentage must be high enough to provide the player with the perception that he or she is receiving good entertainment value for their wagering dollar. In precise mathematical terms, the payback percentage is the Mathematical Expectation (or Expected Value) of the percentage of total money wagered that is returned to the player.

One major problem with many proposed new games is that the player is bombarded with a complicated set of rules that must be fully understood before the player is competent enough at the game to have a fair chance in winning. This understanding can only be accomplished by expending money to play the game. In effect, the player must finance his or her own education about the game. Most players are unwilling to invest their limited time and money to learn a new game they probably perceive as being too complicated in the first place.

Given this, one popular approach taken in developing new games is to make modifications to existing, well known games in an effort to increase their popularity. Ideally, the changes are minor enough to not seriously impact player understanding, yet are substantial enough to provide significant increases in player appeal.

Quite often these modifications take the form of an increased award in an effort to encourage more play. From the game operator's point of view, this has the unfortunate side effect of decreasing the hold percentage. Therefore, in order to be successful at providing an overall increase in revenue, large increases in levels of play must be attained to offset revenue lost due to the decrease in hold percentage. As competition for market share of available wagering dollars intensifies, this type of modification becomes more and more difficult to successfully implement.

Therefore, a need has existed in the prior art for ways of modifying existing well known wagering games so that they are more interesting and popular with the players but without decreasing the hold percentage of the game.

An example of such a modification of a well known video poker game was disclosed in U.S. Pat. No. 4,743,022 to Wood, May 10, 1988, entitled "2nd Chance Poker". In this game, the player of a video poker game can prolong the game by making an additional bet after the conclusion of the initial round of poker that results in the player receiving an additional card which, when combined with the cards already received, may result in the player winning an additional award.

Yet another example of such a modification of an existing video poker game was disclosed in U.S. Pat. No. 5,033,744 to Bridgeman, et al., issued Jul. 23, 1991. Instead of the player receiving five cards, selecting the cards to be retained, and then all at once receiving the replacements for the discards Bridgeman, et al., permits the selective reception of replacement cards, one at a time. This in turn allows the player to prolong play and change strategy depending upon the identity of each of the individual replacement cards.

In all of the games of which Applicant is aware; however, the player will receive an award only after a winning combination is achieved. Further, none of these known games permit the player to be given a choice during a round, permitting the player to make another gambling decision without making an additional wager. Specifically, none of the games of which Applicant is aware, provide an offer of an award during the round itself thereby providing the player the choice of selecting between a guaranteed award, the value of which is based on what the player then holds, or continuing to play the round and receiving an award at the end of the round.

In order to rectify these shortcomings, Applicant has developed the following invention that will provide such a decision for the players during the course of the round. Further, Applicant has developed an invention that is easily implemented on many well-known, existing games.

SUMMARY OF THE INVENTION

The aforementioned needs are satisfied by the present invention, which comprises a modification to games, whereby during a playing round, the player will be offered the opportunity to take a guaranteed award, in lieu of continuing to play to the end of the round, where the player may or may not win, and if wins, receive an award that may or may not be greater than the guaranteed award. Specifically, Applicant's invention can be implemented on any game in which there are a plurality of elements with identifying characteristics in which the player will receive a set number of these elements during the course of the round. Certain combinations of these elements have been defined to be winning combinations, and if the player has any of these winning combinations in the final set number of elements at the end of a round, the player will win an award. Applicant's invention modifies such a game by offering the player an opportunity to accept an award, prior to the player receiving the final set number of elements. If accepted by the player, this guaranteed award will be given in lieu of completing the round to a final set of elements, and either losing and receiving no award, or winning and receiving an award based upon the winning combination of final elements received.

In one of the preferred embodiments, the size of the award that will be offered to the player will be based, in part, on the mathematical likelihood that the player will ultimately receive any of the pre-defined winning combinations, given the elements the player has when the offer is made. In this fashion, the addition of Applicant's invention to existing gambling games such as keno, slot machines, poker, twenty-one, bingo, and the like, can result in the same pay back percentage and hold percentages.

In another one of the preferred embodiments, Applicant's invention is implemented on a well-known video poker game. After the player has made the wager and received the initial cards, the guaranteed award can then be offered to the player. This award can either be some set amount or it can be based upon the likelihood that, given the initial cards the player has, a winning combination will be obtained at the end of the round.

DESCRIPTIONS OF THE PREFERRED EMBODIMENTS

Figure 1:
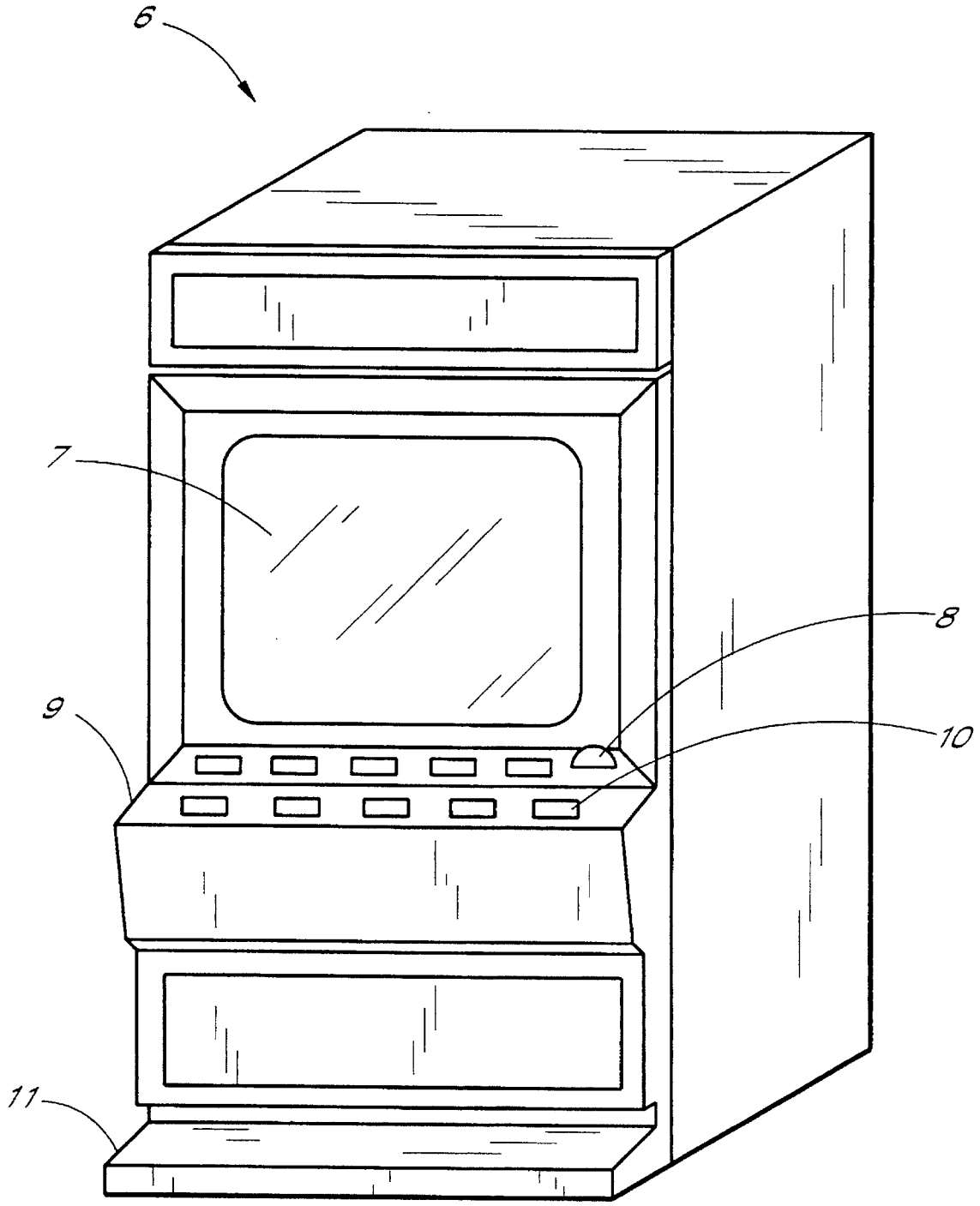
FIG. 1 is a perspective view of a prior art 906III Casino Mini Model Video Poker Game made by United Coin Machine Co. on which one preferred embodiment of the invention is implemented.

In it's most basic form, Applicant has developed an invention that can be used to modify many prior art games, thereby creating entirely new games. Typically Applicant's invention is used on a game in which a player places a wager prior to the start of each individual round of the game. During an individual round, the player will sequentially and preferably randomly receive a series of elements with identifying characteristics from a limited number of such elements available to the game. An award is then given at the pre-determined end of a round if the player has received a certain configuration of elements, which has been previously defined as a winning combination. The size of the award is preferably dependent upon the amount wagered and the probability of occurrence of the winning combination that the player has received.

In this basic preferred embodiment, the invention contemplated by the Applicant is that, prior to the final configuration of elements being determined, the player will be offered a preselected guaranteed award, the "stop play" award, which, if accepted, will cause the round to end. The player then, in effect, will be paid to stop playing during the round. If the player chooses not to accept the award, the player then randomly receives the remaining elements to complete the round, and will receive an award if the final configuration of elements received is one of the winning combinations.

As can be appreciated, the guaranteed award can either be a fixed amount e.g. a portion of the amount wagered, or it can be calculated using the laws of probability as applied to the likelihood the player will receive the additional elements which, when combined with the elements he now has, would produce a winning combination, along with the award that would be given had the player received this winning combination, and, possibly, an additional multiplication factor.

It is well known that when winning combinations are defined as specific configurations or subsets of a limited number of elements that are randomly distributed to the player, the probability that a player will receive a winning combination can be calculated using established probability theory. Hence, in some of the preferred embodiments of Applicant's invention, a key aspect of the invention is to size the selected guaranteed award (the "stop play" award) using probability theory. As can be appreciated by one knowledgeable about games and gaming machines, the gaming industry relies upon quantifiable, predictable payback and hold percentages that fall within statistical limits in evaluating a game. The amount of money retained by the casino, i.e., it's income, is directly related to the amount of money the game pays out. For any specific game, a casino or other gaming establishment must be able to rely upon these payback percentages as accurately representing the long term distribution of awards.

Accordingly, Applicant contemplates, in this preferred embodiment, that the size of the guaranteed award given to the player for stopping play prior to the final configuration of elements being determined, will be directly related to the "Expected Value" of the elements the player possesses when the offer is made. This "Expected Value" is, of course, dependent upon the probability that the elements the player then has will mature into each of the preselected winning combinations, respectively multiplied by the award value of each of the winning combinations. The "Expected Value" (EV) can be mathematically defined as follows:

$$EV = \sum_{n=1}^{N} A_n \cdot P(A_n) \quad (1)$$

where:

EV: is the expected value of the award granted to the player at the end of a round, given conditions existing at the time of the stop play offer;

$A_n$: is the award amount paid at the completion of the round for the nth winning combination;

$P(A_n)$: is the probability of attaining the combination of elements for which the $A_n$ award will be given assuming the round is played to completion; and N: is the total number of winning combinations that can be attained at the end of a round by the player given the elements he currently has.

The calculation of a "stop play" award equal to the "Expected Value" via this formula can be demonstrated by the following example. Assume a hypothetical game in which a player wagers one unit and receives a certain combination of elements. The player can discard any one of the elements and be given a replacement in an effort to attain one of two possible winning combinations. The round will end when the replacements are received by the player. The player will then be given a 10 unit award if the first winning combination is attained ($A_1$) or a 20 unit award ($A_2$) if the second winning combination is attained.

In the basic embodiment of Applicant's invention, the player will be given the opportunity, prior to the end of the round, to take a guaranteed award for stopping play and giving up the ability to receive the rest of the elements necessary for achieving a winning combination. In one preferred embodiment, this award may be the one unit that the player wagered or a portion thereof. In another embodiment, this award could be calculated according to the formula (1) above such that it equals the Expected Value of the elements that have been distributed to the player, given the probabilities that he may receive the additional elements necessary for a winning combination.

In yet another preferred embodiment, acceptance of a stop play award will not preclude the player from the opportunity to receive the additional elements necessary to attain a winning combination of elements. However, awards based on the player having a winning combination of elements would be calculated according to a different pay schedule than what would have been used had the player not accepted the stop play award.

The calculation of the award equal to the Expected Value as per formula (1) is as follows: Given the combination of elements initially received by the player, assume the probability of getting winning combination 1, $P(A_1)$, is 0.1 while the probability of receiving the winning combination 2, $P(A_2)$ is 0.5. In this case the magnitude of the stop play award would be equal to the Expected Value as calculated by formula (1):

$EV=(A_1 * P(A_1))+(A_2 * P(A_2))$ $EV=(10 * 0.1)+(20 * 0.5)$ hence $EV=11$ units.

Thus, the probability based Expected Value of the elements the player has in his hand at this time is 11 units. Consequently, in this preferred embodiment, a stop play award would be offered to the player equal to the 11 units. If the award is accepted, in this preferred embodiment, the round will end. If the player does not accept the stop play award, normal play continues. In one preferred embodiment, after the player has elected to take the "stop play" award, the elements the player would have randomly received had the "stop play" award not been taken are displayed to permit the player to see what would have happened had he not taken the award.

As can be appreciated, equating the "stop play" award to the Expected Value of the elements possessed by the player, will not affect the overall payback percentage or the game hold percentage. This can be illustrated by the following example, using the same hypothetical game as described above.

Assume that the same initial combination of elements is repeatedly given to 2 players at the start of a each round, and each player is always offered the same 11 unit stop play award as above. If the first player always takes the stop play award and the second player always declines the stop play award and continues to play, the amount of money the first player and the second player will receive over the long term will be the same. The first player will receive 11 units per round. The second player, on any given round may win more or less than eleven units depending on the additional elements he receives as the round is played to its conclusion. According to the probabilities given above, the second player will win $A_1=10$ units approximately 1 out of every 10 rounds played, and will win $A_2=20$ units approximately 5 out of every 10 rounds played as $P(A_1)=0.1$ and $P(A_2)=0.5$. Further, the second player will not win any award in approximately 4 out of every 10 rounds played. Thus, for every 10 rounds: the second player will win $A_1$ once, on average; and $A_2$ five times on average, resulting in total average winnings for every ten rounds being equal to $10+(5 \cdot 20)=110$ units. The second player's average winnings per round will be 110 units divided by 10 rounds or 11 units per round.

This example demonstrates that when the "stop play" award is equal to the Expected Value, as calculated by formula (1), the amount of money or units dispensed as a "stop play" award will be the same per round as the average amount of money or units that will be dispensed at the conclusion of each round. Hence, providing the player with the choice of taking the "stop play" award or continuing the game results in an added gaming decision for the player without changing the overall hold or payback percentage of the game.

Of course, in other embodiments of Applicant's invention the hold and payback percentages can be different from this "Expected Value" embodiment. For example, the owner of the game may wish to adjust the size of the "stop play" award to either encourage or discourage the player from taking the stop play award in lieu of continuation of play. In this preferred embodiment, the size of the stop play award may be calculated according to the following formula:

$$\text{Stop Play Award} = F * \sum_{n=1}^{N} A_n * P(A_n) \quad (2)$$

where:

F: is an adjustment factor;

$A_n$: is the award amount paid at the completion of the round for the nth winning combination;

$P(A_n)$: is the probability of attaining the combination of elements for which the $A_n$ award will be given, assuming the round is played to completion; and N: is the total number of winning combinations that can be attained at the end of a round by the player given the elements he currently has.

If the adjustment factor F is greater than 1, then the "stop play" award will be greater than the Expected Value of the elements the player then holds. Hence, in this scenario, the pay back percentage will be increased and the hold percentage will be decreased. As can be appreciated by a person familiar with the gaming industry, increasing the pay back percentage may be desirable to encourage players to play the game by giving them better odds. Increased volume play may then result in more money for the owner of the game even though the hold percentage has been decreased.

However, if the adjustment factor is less than 1, then the "stop play" award will be less than the Expected Value of the elements the player then holds. Hence, in this case, the pay back percentage will be decreased and the hold percentage will be increased. As can also be appreciated by a person familiar with the gaming industry, it may be desirable to provide the option of a "stop play" award; however, the owner of the game may wish to retain more of the money when such an option is taken by the player.

The Expected Value of the elements that the player has when the "stop play" offer is made may not correspond to a number of coins or units that can be paid out. For example, the expected value may include a fractional component e.g. 5.07 units. It may be impractical to dispense fractional units of awards, particularly in coin operated gaming devices, which typically dispense awards comprised of the coin they are configured to accept e.g., quarters, tokens, etc.

Fractional units are generally referred to in the gaming industry as breakage. One solution for handling breakage is to have the stop play awards rounded either up or down to the nearest readily dispensable whole unit. In one preferred embodiment, the stop play award is rounded down and the breakage is accumulated into an account that can be used to increase the hold percentage of the game or it can be stored separately to form the basis of a progressive jackpot that will be awarded on the occurrence of a specific event. It is also possible to link several "stop play" equipped gaming machines together, in a manner known in the art, and accumulate the breakage of the several gaming machines into a single account to thereby increase the size of a progressive jackpot.

It is also possible to redistribute breakage by offering increased stop pay awards under certain special conditions. For example, assume that the breakage account has reached a total of 9.76 units and that game conditions were such that a 3.0 unit expected value has been calculated when the "stop play" award option is presented to the player. A separate criteria for offering a special bonus "stop play" award may be implemented to dispense a 12 unit "stop play" award thereby leaving 0.76 units in the breakage account. For example, after repeated rounds of a game without the player electing the "stop play" award, the "stop play" award may be increased by adding some or all of the breakage account accrued from previous "stop play" awards, creating one enhanced "stop play" award to thereby encourage the player to take the "stop play" award more often.

In one presently preferred embodiment the invention is implemented as a feature of a prior art video poker game. FIG. 1 shows a typical video poker game 6 known in the art, such as a Model 906III Casino Mini Video Poker Machine manufactured by United Coin Machine Company. The video poker game 6 is generally rectangular in shape and contains a video display screen 7 on which various instructions and representations of playing cards are made visible to the player. The video poker game 6 also includes a coin accepting mechanism 8 that is configured to receive a specific type of coin or token, e.g. nickels, dimes, quarters, or tokens representative of some value, monetary or otherwise. Generally, the types of coins or tokens accepted by the coin accepting mechanism 8 form the basic "unit" of valuation for the machine, and all awards are then dispensed in integer multiples of these units. Other games of this type are also equipped with a paper currency acceptor in addition to the coin acceptance mechanism. The video poker game 6 also contains a control button panel 9 (showing ten control buttons 10), which permits the player to start the game, place bets, select cards to be held and cards to be discarded, and collect accrued winnings. The video poker game 6 also contains a coin return tray 11 in which any awards that the player may receive will be deposited either after each winning round, or when the player cashes out the accumulated credits stored by the video poker game 6.

The typical operation of prior video poker games such as the game shown in FIG. 1 is as follows. The player inserts a coin or multiple coins into the coin accepting mechanism 8. The video poker game 6 then randomly deals five cards from a randomly shuffled deck of 52 cards, representations of which are then displayed on the video screen 7. As can be appreciated by a person skilled in the art however, the video poker game 6 can be configured to use more than one deck of cards. The machine is also configured to deal and display the five cards in response to the player depressing one or more of the control buttons 10, which will wager the accumulated credits of the player. The player will select which cards he wishes to keep or "hold" and which cards he wishes to discard by manipulating the buttons 10 on the control button panel 9. The poker game 6 then replaces the cards that the player indicated as discards with fresh cards, randomly selected from the remaining 47 cards of the 52 card deck. Representations of these new cards are displayed on the video screen 7 in the place of the discarded cards.

Typically, at this point if the representation of the cards now shown on the video screen 7 is one of a preselected winning combination of cards, the player will receive an award. A typical schedule of awards, known as a pay table or pay schedule, is shown in Table 1 below, where the awards for each of the well known combination of playing cards are expressed in terms of coins won per coin wagered.

| FINAL HAND | AWARD AMOUNT (Coins Won Per Coin Wagered) |
|---|---|
| Pair of Jacks or Better | 1 |
| Two Pairs | 2 |
| Three of a Kind | 3 |
| Straight | 4 |
| Flush | 5 |
| Full House | 8 |
| Four of a Kind | 25 |
| Straight Flush | 50 |
| Royal Flush | 800 |

Figure 2:
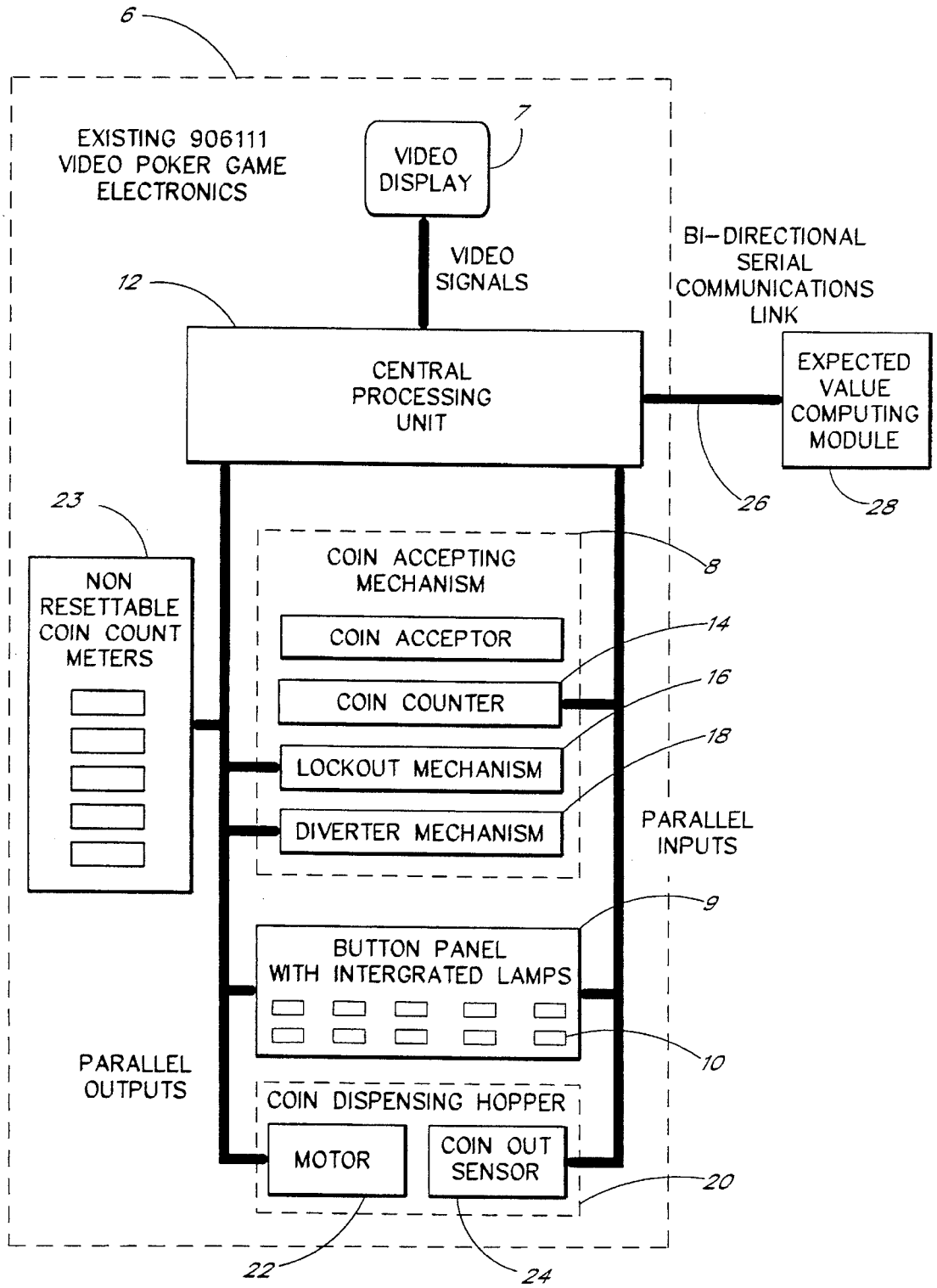
FIG. 2 is a block diagram of a preferred embodiment of the present invention showing the basic electrical implementation of the invention on the 906III Casino Mini Model Video Poker Game shown in FIG. 1.

FIG. 2 shows a block diagram of the hardware components comprising a preferred embodiment of Applicant's invention as it is implemented in a video poker game like the game shown in FIG. 1. In particular, it is noted that the video poker game 6 typically contains the video display screen 7 that is electrically connected to a central processing unit 12 which, in the case of the Model 906III Casino Mini Video Poker Machine built by United Coin Machine Company, is a Rockwell 6502 micro-processor based central processing unit. This central processing unit 12 controls all of the game functions including shuffling the deck, randomly selecting the cards to be dealt to the player, reading the player's inputs on the control buttons 10, determining the awards according to a pay schedule (e.g., the schedule shown in Table 1), and causing representations of the cards as well as instructions to be displayed to the player on the video display screen 7. The central processing unit 12 is also electrically connected to the coin accepting mechanism 8.

The coin accepting mechanism 8 includes a coin counter 14 that provides inputs to the central processing unit 12 of all the coins entered into the game. This permits the central processing unit 12 to, among other things, base awards, if any, on the number of coins entered in each round. The coin accepting mechanism 8 also contains a lockout mechanism 16 that, upon receipt of inputs from the central processing unit 12, will prevent coins from being accepted by the machine at inopportune times, e.g., in the middle of a hand, under error conditions, etc. The coin accepting mechanism 8 also contains a diverter mechanism 18 that will direct each coin into either a locked container for later removal (not shown) or into a payout hopper 20 for eventual payout to players in the form of awards.

Also electrically coupled to the central processing unit 12 are a series of non-resettable coin count meters 23 that keep a non-volatile record of coins wagered, coins won3, coins diverted into the locked container and other relevant information necessary to monitor game performance. The video poker game 6 also contains the control button panel 9 with a multiple number of control buttons 10 (ten shown). These buttons are preferably capable of being lit by an integrated lamp in response to signals generated by the central processing unit 12, indicating that the button can be activated by the player. Each of the buttons 10 in the control button panel 9 provides inputs to the central processing unit 12, thereby permitting the central processing unit 12 to perform operations and calculations in response to the inputs provided by the player.

Also electrically connected to the central processing unit 12 is a coin dispensing hopper 20. The coin dispensing hopper includes a motor 22 and a coin out sensor 24 and it operates as follows. When an award situation arises or when the player cashes out his accumulated credits, the central processing unit generates signals which cause the motor 22 to activate resulting in the coin dispensing hopper 20 dispensing coins into the coin return tray 10. The coin out sensor 24 counts the number of coins dispensed by the hopper 20 and, when the correct amount of coins has been dispensed, the sensor 24 sends a signal to the central processing unit 12 which then turns off the motor 22 thereby stopping the dispensing of coins.

Also electrically connected to the central processing unit 12 is a coin dispensing hopper 20. The coin dispensing hopper includes a motor 22 and a coin out sensor 24 and it operates as follows. When an award situation arises or when the player cashes out any accumulated credits, the central processing unit generates signals that cause the motor 22 to activate resulting in the coin dispensing hopper 20 dispensing coins into the coin return tray 10. The coin out sensor 24 counts the number of coins dispensed by the hopper 20 and, when the correct amount of coins has been dispensed, the sensor 24 sends a signal to the central processing unit 12 that then turns off the motor 22, thereby stopping the dispensing of coins.

The central processing unit 12 can either cause the award coins to be dispensed after each round in which an award has been won, or it can accrue all coins won by the player to a credit account referred to as a credit meter (not shown). The current balance of the credit meter is displayed to the player on the video screen 7 and the player can either make wagers using the accumulated credits by depressing an appropriate one of the control buttons 10 or the player can "cash out" all accumulated credits by depressing another one of the control buttons 10.

Connected via a bi-directional serial communication link 26 to the central processing unit 12 is an expected value computing module 28. The expected value computing module 28 will calculate the stop play or surrender award for the video poker game described herein according to the formula (1), above. As can be appreciated by a person skilled in the art, the interface between the central processing unit 12 and the expected value computing module 28 can also consist of a parallel data communication interface (not shown in FIG. 2) instead of the serial communication link 26.

Figure 3:
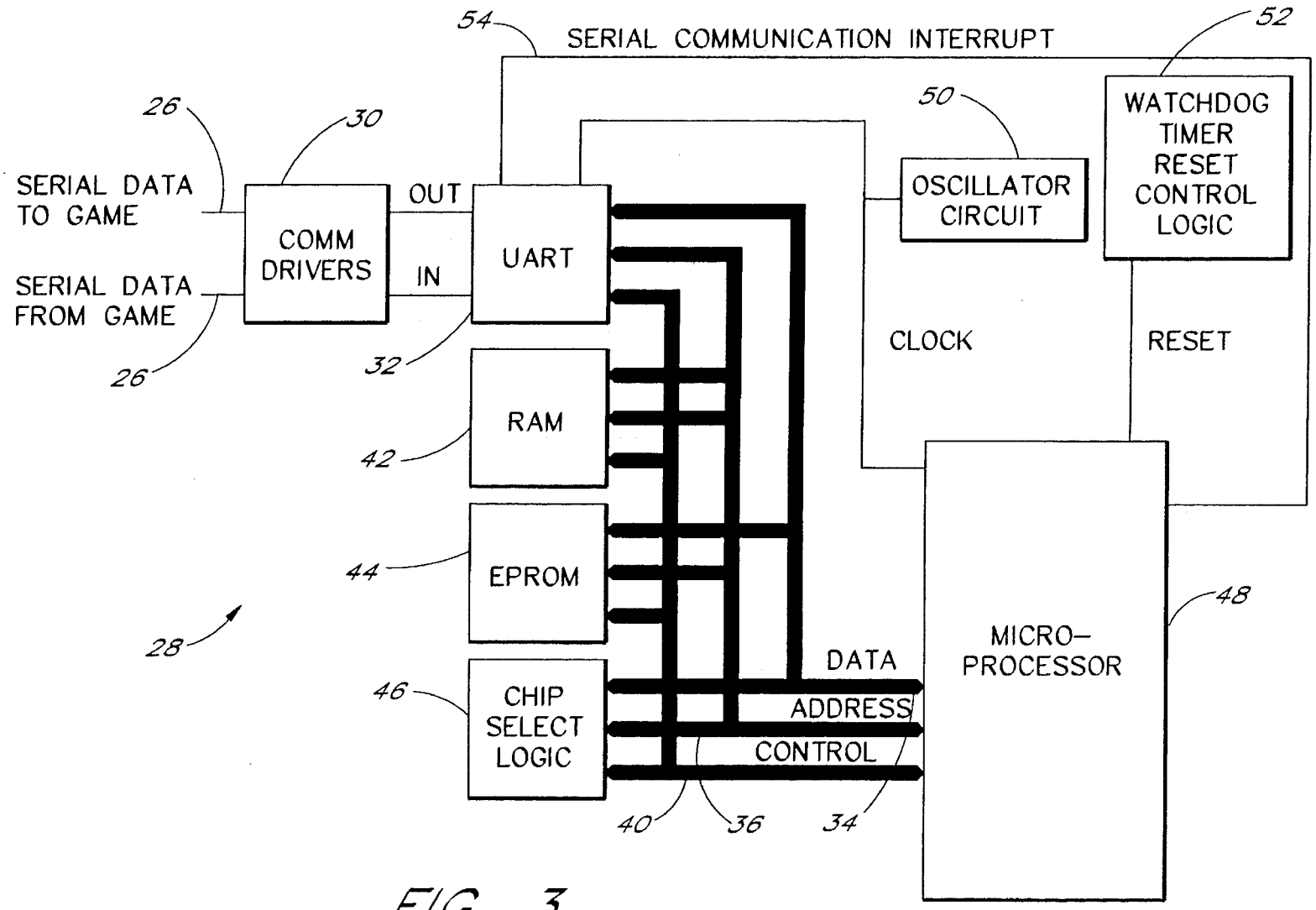
FIG. 3 is a block diagram of the Expected Value Computation Module of the preferred embodiment shown in FIG. 2.

FIG. 3 is a block diagram showing the components of the expected value computing module 28. The bi-directional serial communications link 26 is connected to a communication driver circuit 30 that contains a communication driver for providing serial data to the central processing unit 12 of the video poker game 6 and a communication receiver for receiving serial data from the central processing unit 12 in the video poker game 6. Preferably, these are National Semiconductor, DS 1488 and DS 1489 communication drivers respectively. The communication driver circuit 30 has both an input and an output to a Universal Asychronous Receiver and Transmitter ("UART") 32 of a type known in the art such as an Intel 8251 UART. The UART 32 translates the serial signals received from the communication driver circuit 30 into parallel signals for processing by the expected value computation module 28, and it translates parallel signals received from other components of the module 28 into serial signals capable of being sent serially to the central processing unit 12 in the video poker game 6 via the bi-directional communication link 26.

The UART 32 is connected to the rest of the module 28 via a data input/output bus 34, an address input/output bus 36 and a control input/output bus 40. Each of these busses are also connected to a Random Access Memory ("RAM") array 42, an erasable programmable read only memory ("EPROM") array 44, a chip select logic circuit 46 and a microprocessor 48. The microprocessor 48 is preferably an Advanced Micro Devices AM29050 microprocessor that receives the following data from the central processing unit 12 via the UART 32 and the data bus 34; the pay table type, which indicates the award schedule currently in effect; the starting hand of the player; and the current amount of any variable awards, commonly referred to as progressive jackpots, as well as extra bytes of information used to verify that the transmitted data is not corrupted during the communication process.

The EPROM array 44 is preferably comprised of four connected Intel 27256 32k×8 U.V. erasable programmable read only memories, which contain the algorithm for performing the calculation of the Expected Value (as per formula (1), above) for the video poker hand possessed by the player. The Random Access Memory Array 42 is preferably comprised of four Hitachi 6264 8k×8 RAMs, which will store the intermediate values calculated by the microprocessor 48 when it is implementing the Expected Value algorithm stored in the EPROM array 44 on the data provided by the central processing unit 12.

The Chip Select Logic circuit 46 is preferably an Advanced Micro Devices 29MA16 Programmable Array Logic ("PDL") circuit that controls and addresses the flow of information over the input/output busses 34, 36, 40 to the various components in response to input signals from the microprocessor 48.

An oscillator circuit 50 providing a clock input is also connected to the microprocessor 48 and to the UART 32. A watchdog timer and reset control logic circuit 52 is also connected to the microprocessor 48, which will reset the microprocessor 48 when it detects an error in its operation or when it detects an error during the powering up of the microprocessor 48. The UART 32 can also send a serial communication interrupt signal on a serial communication interrupt signal line 54 to the microprocessor 48 in the event that it has received data from the central processing unit 12.

Figures 4, 4A, 4B, 4C:
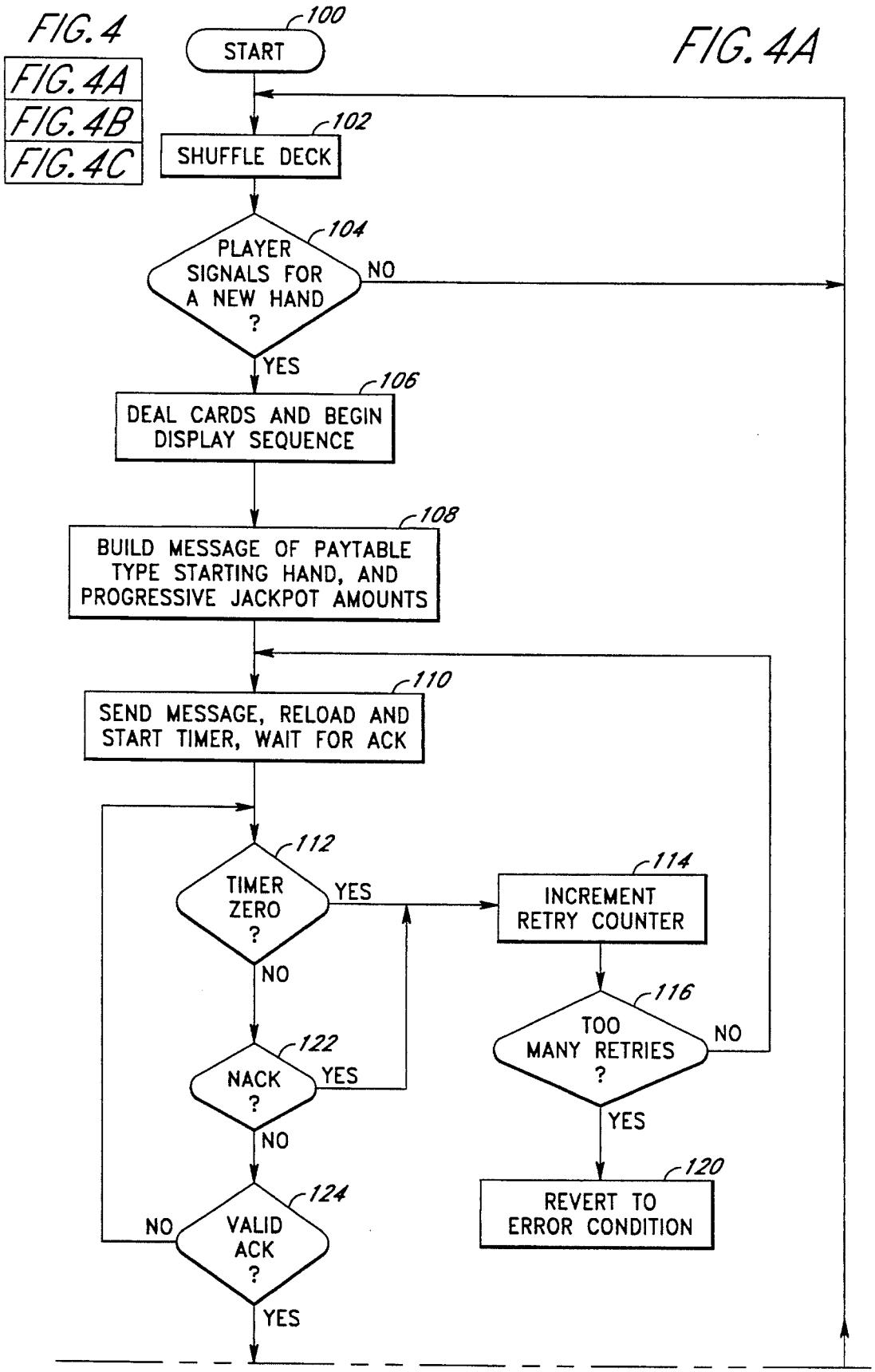
FIG. 4 is a key to the reconstruction of FIGS. 4A–4C which are a flow diagram of the operation of the preferred embodiment shown in FIG. 2 during the course of a single five card video poker hand.
Figure 4B:
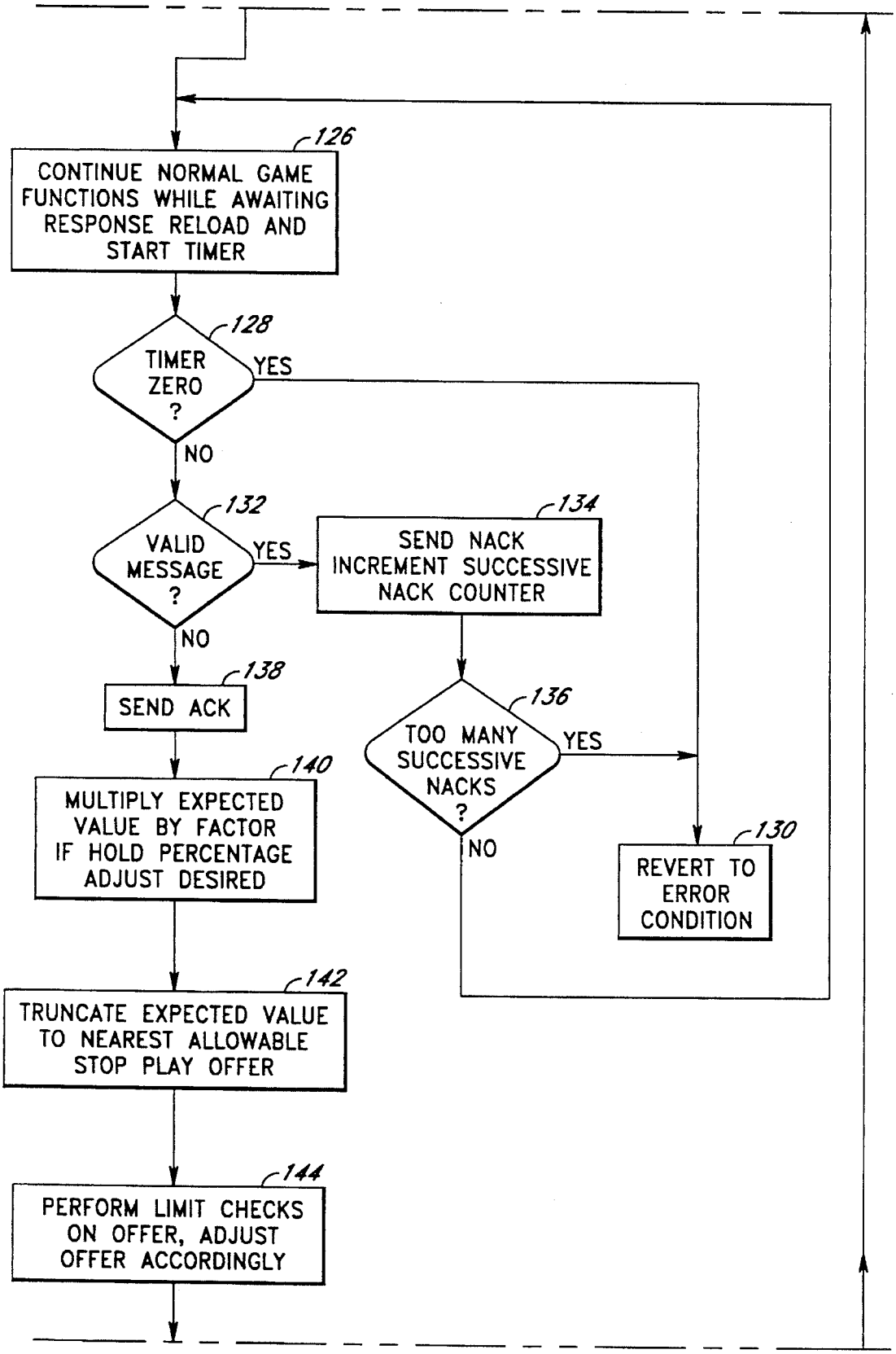
Figure 4C:
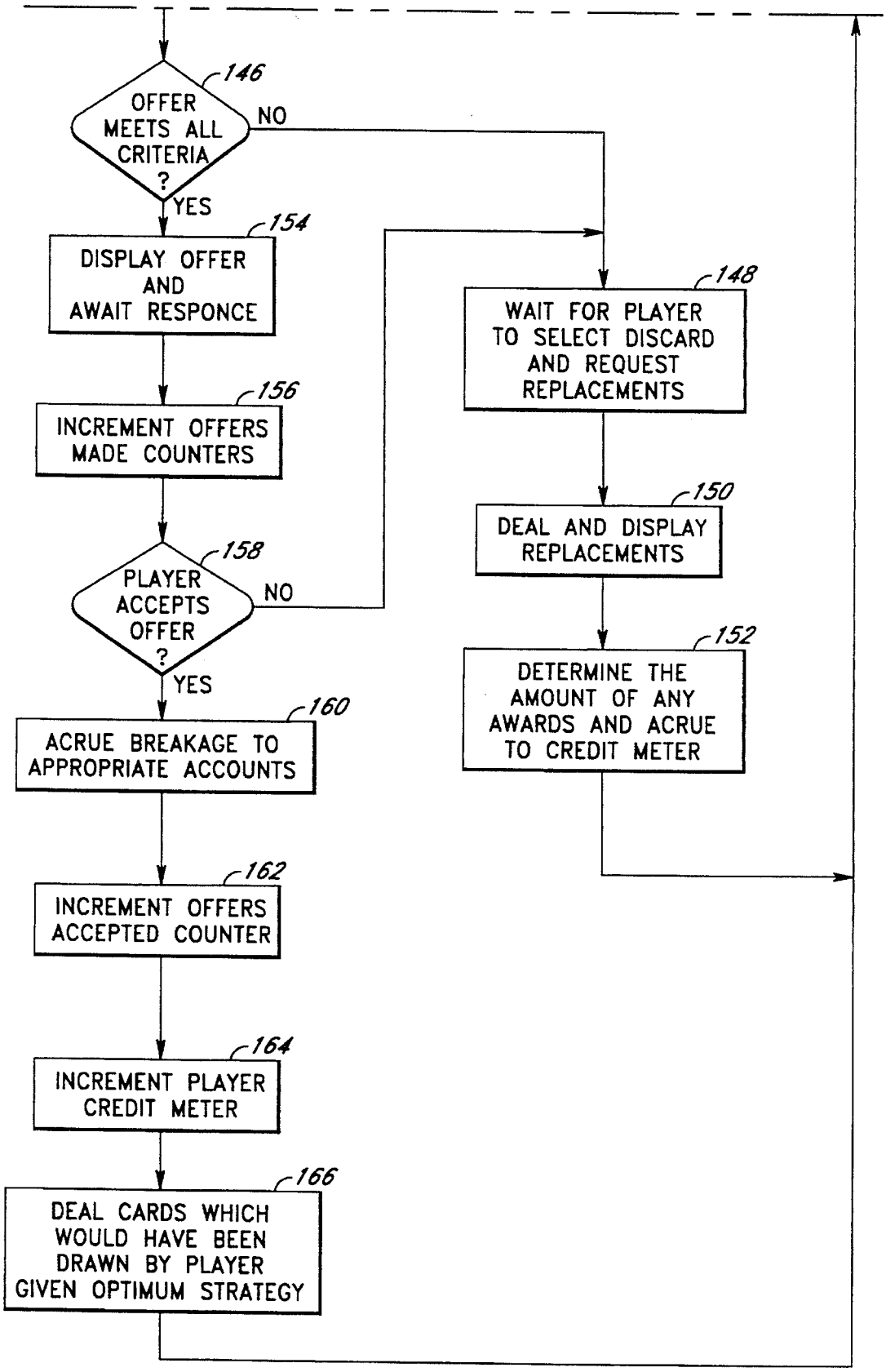

FIG. 4 illustrates the flow diagram of the preferred embodiment implementing Applicant's invention on the video poker game 1 during the course of one five card video poker hand. Beginning at a start state 100, where the video poker game 6 is powered up, the central processing unit 12 will initiate a process of continuously electronically shuffling 102, or randomly distributing the sequence, of a electronic signals representative of a 52 card playing card deck. The central processing unit 12 will then move to a decision state 104 where it will determine whether the player has signalled for a new hand.

When the player deposits a coin into the coin accepting mechanism 8 or wagers a previously won credit by pressing an appropriate button 10, the central processing unit 12 will preferably cause a message to appear on the video screen 7 after each coin is deposited indicating the total number of coins deposited and it will also provide instructions on how to continue playing the game. After the player has deposited the desired number of coins he will then depress an appropriately marked and preferably lit button 10 e.g. marked "deal" or the like, on the button control panel 9, which will signal to the central processing unit 12 that the player has requested a new hand be dealt.

Only after the player has signaled for a new hand, will the central processing unit 12 move to deal and display a state 106 where it will select the cards to be dealt and initiate the display representations of those cards on the video display 7. After displaying the completed deal, the central processing unit 12 will then move to a state 108 where it will build a message to be sent to the expected value computation module 28 over the bi-directional communication link 26. The message will include information relating to the pay table, the wager amount, the player's starting five card hand, any variable awards, e.g., progressive jackpots etc., as well as additional information that will ensure that the transmitted data has not been corrupted by the communication process.

After this message has been built, the central processing unit 12 will move to a state 110 where the message will be transmitted to the expected value computation module 28 over the communication link 26. Additionally, in this state, a timer within the central processing unit 12 will be loaded with a pre-selected number. This timer will then count down to zero. The next series of states (states 112 to 124) ensure that the data has been correctly transmitted to the expected value computation module 28 without any induced errors.

The central processing unit 12 first goes to a decision state 112 where it checks to make sure that the internal timer does not equal zero. If the timer is equal to zero, the central processing unit 12 will then go to a state 114 where an internal retry counter will be incremented. The retry counter is internal to the central processing unit 12 and it is initialized at zero when the central processing unit 12 is initialized in the start state 100. After the internal retry counter has been incremented, the central processing unit 12 then goes to a decision state 116 where the value of the retry counter is compared against a pre-selected maximum number of acceptable retries. If the retry counter exceeds the maximum number of acceptable retries, the central processing unit 12 will then move to a state 120 where the central processing unit 12 and the video poker game 6 revert to an error condition precluding further play until the problem is resolved. If the retry counter does not exceed the maximum number of acceptable retries, the central processing unit 12 will then return to the state 110 where it will again send the message to the expected value computation module 28 and initiate the internal timer.

If the central processing unit 12, in the state 112 detects that the timer is not equal to zero, the central processing unit 12 will then move to a decision state 122 where it will check to see if it has received a negative acknowledgement signal ("NACK") from the expected value computation module 28. The expected value computation module 28 will transmit a NACK signal to the central processing unit 12 if it detects that it has received corrupt data. The detection of receipt of corrupt data is done by the microprocessor 48 within the module 28 by using an algorithm, such as a check sum or cyclic redundancy check to determine that the data sent was correctly received. If the central processing unit 12 receives a NACK signal from the module 28 via the communication link 26, the central processing unit 12 will then go to state 114 where the retry counter will be incremented. After the retry counter has been incremented, the central processing unit 12 moves to decision state 116 where it will check to see if there has been too many retries. If there has been, the central processing unit 12 will go to the error condition state 120, and if not, the central processing unit 12 will be returned to the state 110.

If the central processing unit has not received a NACK signal from the module 28 via the communication link 26, the central processing unit will then move to a state 124 where it will check to see if it has received an acknowledgement ("ACK") signal from the module 28 via the communication link 26. The module 28 will send an ACK signal to the central processing unit 12 via the communication link when it determines that it has received good data. If the central processing unit 12 has not received an ACK signal from the module, it will return to the timer zero decision state 112. If the central processing unit has received an ACK signal from the module 28, it will then move to a next state 126.

The states 110 through 124 ensure that the data is received by the module 28 and acknowledged to the central processing unit 12 within a pre-selected time period as determined by the timer within the central processing unit 12. The states 110 through 124 will further resend the data to the module 28 for a selected number of times until the retry counter exceeds the maximum number of permissible retries, at which time the central processor will then revert to an error state 120. As can be appreciated by a person skilled in the art, the method of ensuring accurate data transmission described herein is but one of many possible methods, any other of which may be used.

When the central processing unit 12 moves to the state 126, after having received a valid acknowledgement signal from the module 28, it will continue to perform all its normal game functions while it reloads and starts another timer of similar construction and operation as the aforementioned timer. The central processing unit 12 then moves to a decision state 128 where it checks to see if the timer is equal to zero. If the central processing unit 12 detects the timer is equal to zero, this signals to the central processing unit 12 that it has not received the Expected Value Calculation within the required period as determined by the timer. The central processing unit will then move to an error state 130 which will inhibit further play on the video poker game 1 until the error is resolved.

If the central process unit 12 detects that the timer is not equal to zero, it will move to a decision state 132 where it will check to see if it has received a valid message from the module 28 containing an expected value and an optimum play strategy. The validity of the message is tested by applying an algorithm, such as a check sum or cyclic redundancy check to determine whether the data sent was correctly received. If the central processing unit 12 decides in the state 132 that a valid message was sent, it then moves to a state 138 where it sends an acknowledgement (ACK) signal to the module 28. This signal indicates to the microprocessor 48 within the module 28 that the message was received and that it need not attempt to send the signal again.

If the central processing unit 12 has not received a valid message from the module 28, it will move to a state 134 where it will send a negative acknowledgement (NACK) signal to the module 28 as well as increment a successive NACK counter. The successive NACK counter is internal to the central processing unit 12 and it is initialized in the start state 100. When the module 28 receives a NACK signal from the central processing unit 12, the module 28 will attempt to resend the message to the central processing unit 12.

The central processing unit 12 then moves to a decision state 136 where it compares the value of the successive NACK counter to a pre-selected number of maximum NACK signals, to determine whether there has been too many NACK signals sent to the module 28. If the successive NACK counter registers more NACK signals sent than the pre-selected maximum, the central processing unit 12 will then revert to the error state 130. If the successive NACK counter registers less NACK signals sent than the pre-selected maximum, the central processing unit 12 will then return to the state 126 to repeat this process.

The states 126 through 136 ensure that the message received from the module 28, containing the Expected Value and the Optimum Play Strategy are properly received by the central processing unit 12 over the communication link 26. As can be appreciated by a person skilled in the art, the method of ensuring accurate data transmission described herein is but one of many possible methods, any other of which may be used.

After the central processing unit 12 sends the acknowledgement signal in the state 138 it then moves to a state 140 wherein the expected value calculated by the module 28 may optionally be multiplied by a factor F, where the video poker game 6 is one offering stop award payments according to formula (2) reproduced below:

$$\text{Stop Play Award} = F * \sum_{n=1}^{N} A_n * P(A_n) \qquad (2)$$

where:

F: is an adjustment factor;

$A_n$: is the award amount paid at the completion of the round for the nth winning combination;

$P(A_n)$: is the probability of attaining the combination of cards for which the $A_n$ award will be given assuming the round is played to completion; and N: is the total number of winning combinations that can be attained at the end of a round by the player given the five cards he currently has.

Preferably, in embodiments that calculate the stop play award according to formula (2), the owner of the video poker game 6 will be able to access the central processing unit 12 to set the adjustment factor F to the value desired. As is understood, however, by a person familiar with the gaming industry, the method of access is dependent upon the governing laws of the jurisdiction in which the game is used and varies accordingly.

The central processing unit 12 will then move to a state 140 where it truncates the expected value (or the expected value multiplied by the adjustment factor F, depending on the embodiment in use) to the nearest allowable stop play offer. The nearest allowable stop play offer typically will be the number of coins, in use in the video poker game 6, nearest in value to the value of the stop play award calculated in the state 138. The central processing unit 12 then moves to a state 144 where the central processing unit 12 performs checks on the offer and adjusts the offer accordingly.

The central processing unit 12 then moves to a decision state 146 where the offer is compared against pre-selected criteria. The criteria can include establishing a minimum expected value at which an award will be offered or it can include criteria related to legally imposed minimum payout requirements. If, for example, the expected value of the player's initial five card hand falls below this value then an award will not be offered and the central processing unit 12 will then move to a state 148. As can be appreciated, the selected criteria can also include such things as only permitting an offer to be made if a certain threshold amount of coins are wagered, permitting an offer only if it exceeds the wager amount or permitting the offer to be made on every other hand played or every third hand or even on only randomly selected hands.

Assuming that the preselected criteria has not been met in decision state 146, the central processing unit will move to the state 148 where it will wait for the player to select the cards to be retained. After the player has selected the cards he wishes to retain and has signalled for replacement cards using the appropriate buttons 10 on the button control panel 9, the central processing unit 12 will then move to a state 150 where it will deal and display the replacement cards on the video screen 7. The central processing unit 12 will then move to a state 152 where it will determine whether the combination of cards justify an award and, if so, it will either send a signal to the coin dispensing hopper 20 to dispense the appropriate award or increment an electronically-stored credit meter. Winning combinations and awards will be calculated according to a pay schedule similar to the schedule shown in Table 1.

If the criteria for an offer is met in the decision state 146, the central processing unit 122 will then move to a state 154 where it will cause the "stop play" offer and instructions on how to accept or decline the offer to be displayed to the player on the video screen 2. After the offer has been displayed, the central processing unit 12 will await the player's response and will move to a state 156 where it will increment a counter which records offers made. The offer made counter is either stored internally within the central processing unit 12 or comprises one of the non-resettable coin count meters 22. The information stored therein permits the owner of the video poker game 6 to evaluate the popularity of the stop play award feature of that particular game.

The central processing unit 12 then moves into a decision state 158 where it will await inputs from the player via the control button panel, 9 indicating whether the player has accepted or declined the stop play offer. If the player declines the stop play offer, then the central processing unit 12 moves to the state 148 and proceeds as previously described. If the player accepts the stop play offer, then the central processing unit 12 moves to a state 160 where any breakage is accrued to an appropriate account. The central processing unit 12 then moves to a state 162 where an offers accepted counter of a type similar to an offers made counter is incremented.

The central processing unit 12 then moves to a state 164 where the player's credit meter is incremented by the amount of the award. Alternatively, in state 164, the central processing unit 12 could signal the coin hopper 20 to dispense the number of coins constituting the "stop play" award.

The central processing unit 12 then moves to a state 166 where it represents to the player the optimum strategy that was determined by the module 28. The optimum strategy displayed will include showing the player which cards would have been the optimum cards to discard, and what replacement cards would have randomly been supplied from the deck assuming the player had elected to continue play without accepting the stop play award. From this the player can evaluate what, if any award would have been paid had the "stop play" offer not been accepted. Further, this also serves to educate the players as to what the optimum discard strategy is for that particular hand.

After the central processing unit 12 completes the state 166, it then returns to the start state 100 and will await the next signal indicating that a credit has been wagered or a coin has been deposited.

In this above described preferred embodiment, if the player chooses to accept the stop play award, the central processing unit 12 in the decision state 158 will then move to state 160 without permitting the player to continue playing the game. In another preferred embodiment, however, Applicant contemplates that if the player accepts the stop play award, the central processing unit 12 in the decision state 158 would move through states 160, 162, and 164 but then move to a state 165 (not shown) where the central processing unit 12 would change the pay schedule from which winning awards are determined to a second pay schedule and then move to state 148 where the player would be permitted to continue playing. When the central processing unit 12 moved into state 152 where it determined the amount of the award, if any, for the winning combination that the player had, it would use the second pay schedule. As can be appreciated, the second pay schedule could be designed so that it paid out smaller winnings, or it limited the winning combinations to certain combinations of cards.

Figures 5, 5A, 5B:
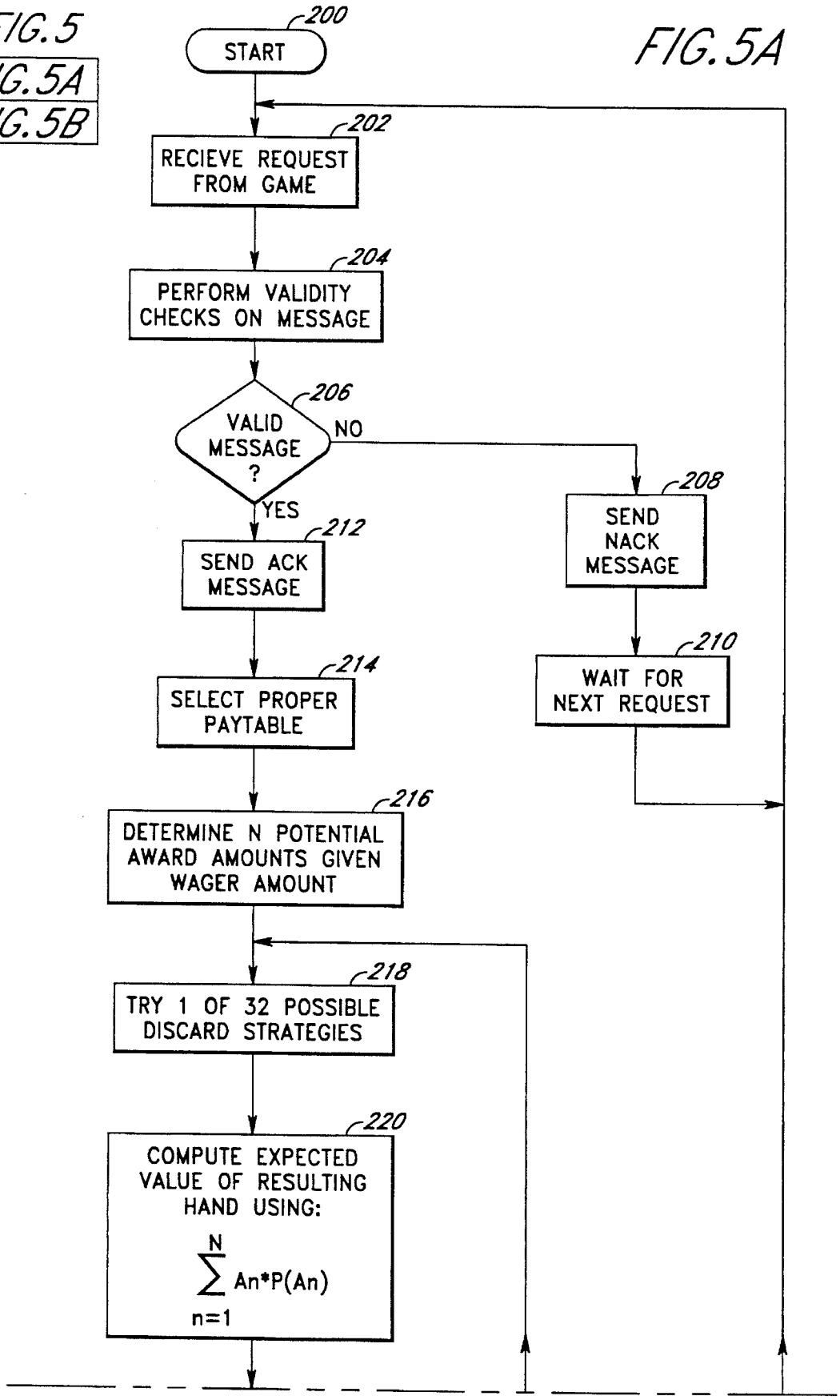
FIG. 5 is a key to the reconstruction of FIGS. 5A–5B which are a flow diagram of the computation of the expected value as performed by the Expected Value Computation Module shown in FIG. 3.
Figure 5B:
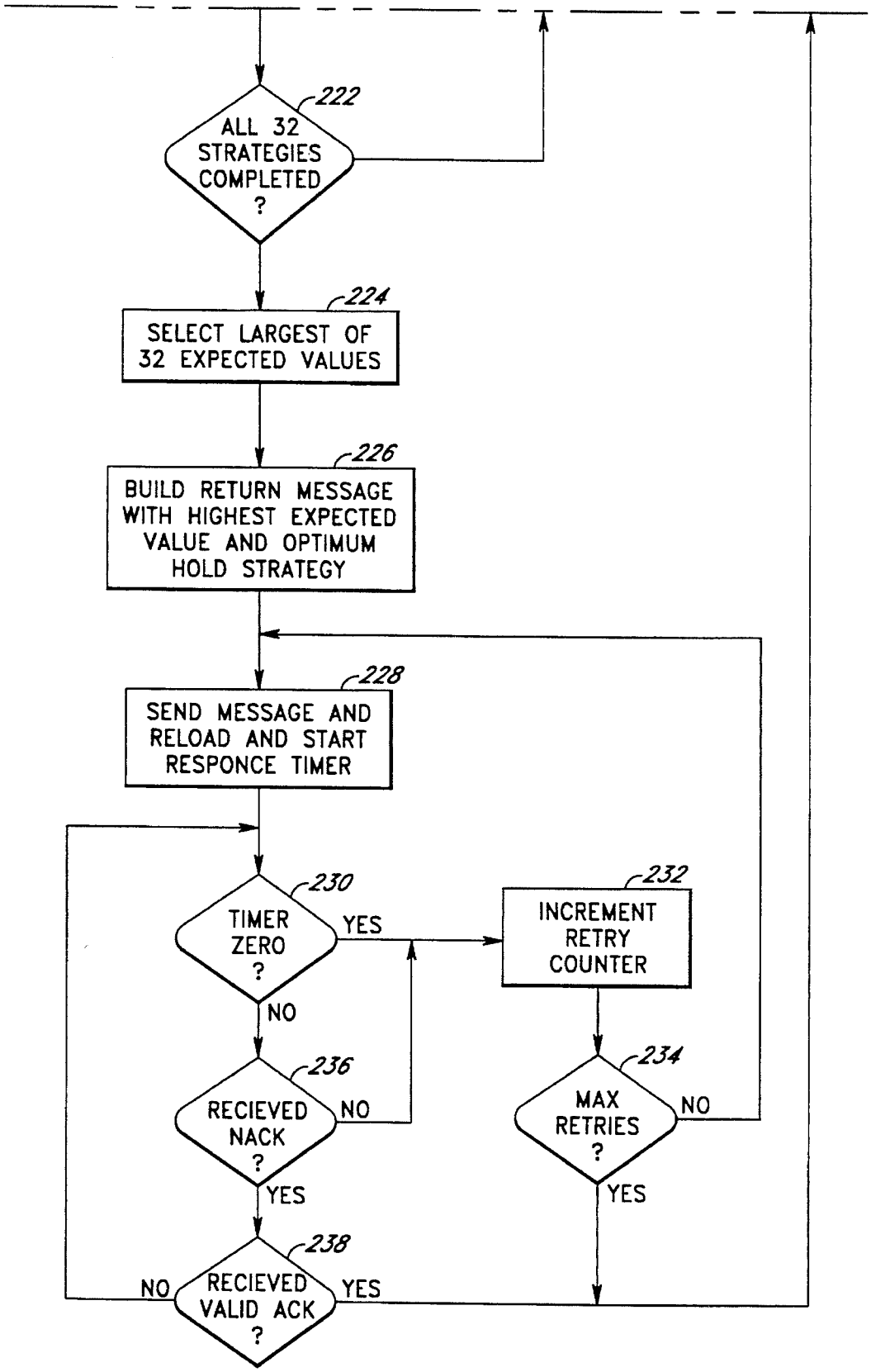

FIG. 5 illustrates the flow diagram of the expected value computation module 28 in the preferred embodiment shown in FIG. 4 as it calculates the expected value of a five card video poker hand. Beginning at a start state 100, where the components comprising the module are initialized, the module 28 will await inputs from the central processing unit 12 of the video game 6 via the communication link 26. Upon receipt of inputs from the central processing unit 12 requesting an expected value calculation, the module 28, and in particular the microprocessor 48, will then enter a state 202 where the message from the central processing unit 12 will be read and interpreted. This message will include information relating to the wager amount, the initial five card hand the player has, the pay schedule applicable to this hand, the current amount of any variable awards, commonly referred to as progressive jackpots, as well as extra bytes of information used to verify that the transmitted data is not corrupted during the communication process.

The microprocessor 48 then moves to state 204 where it performs the previously described validity checks on the message received from the central processing unit 12 via the communication links 26. After performing these validity checks, the microprocessor 48 then enters a decision state 206 where it determines whether the message received from the central processing unit 12 is valid. If it decides that the message was invalid due to erroneous communication from the central processing unit 12, the microprocessor 48 enters a state where it causes the UART 32 and the communication 30 to send a non-acknowledged (NACK) signal back to the central processing unit 12. After sending the NACK signal, the module 28 then enters a state 210 where it waits for the next request for an expected value calculation from the central processing unit 12.

If the microprocessor 48 decides that the message received from the central processing unit 12 was valid in the decision state 206, the microprocessor 48 then moves into a state 212 where it sends an acknowledgement (ACK) signal to the central processing unit 12 indicating that the message was accurately received by the module 28. The microprocessor 48 then moves into a state 214 where it will select the proper pay table from the EPROM array 44. As previously indicated, the central processing unit 12 sends to the module 28 a signal indicating which pay schedule is appropriate for this particular round, and the microprocessor 48 retrieves this pay schedule from storage within the EPROM array 44. This ensures that the award amounts used in the expected value calculation match the award amounts currently in effect on the video poker game 6.

The microprocessor 48 then moves into a state 216 where given the inputs of the pay schedule then in effect, and the amount wagered by the player, the award amounts $A_n$ for the total number N of possible winning hands are calculated and separately stored in the RAM array 42. The microprocessor 48 then moves into a state 218 where it selects 1 of 32 possible discard strategies. As can be appreciated, with five card video poker, there are a total of five cards each of which can either be held or discarded, hence there are $2^5$ or 32 possible discard strategies. After selecting one of the possible discard strategies, the microprocessor 48 then moves into a state 220 where the expected value of the hand, using the selected discard strategy is calculated according to formula (1) reproduced below:

$$EV = \sum_{n=1}^{N} A_n * P(A_n) \tag{1}$$

where:

EV: is the expected value of the award granted to the player at the end of a round given conditions existing at the time of the stop play offer;

$A_n$: is the award amount paid at the completion of the round for the nth winning combination;

$P(A_n)$: is the probability of attaining the combination of cards for which the $A_n$ award will be given assuming the round is played to completion; and N: is the total number of winning combinations that can be attained at the end of a round by the player given the cards he currently has.

In the state 220, the microprocessor 48 calculates the probability of each occurrence of the N number of possible winning card combinations $P(A_n)$ for this particular discard strategy using an algorithm stored in the EPROM array 44. The microprocessor 48 then multiples this probability $P(A_n)$ with the previously calculated expected award $A_n$ stored in the RAM array 42 for each of the N number of possible winning card combinations. The product $A_n * P(A_n)$ for all the N number of possible winning combinations for this discard strategy is then summed together by the microprocessor 48, which give the total Expected Value for this discard strategy. This summed Expected Value, $\Sigma A_n * P(A_n)$ along with the discard strategy needed to achieve this summed Expected Value is then stored in the RAM array 42.

The microprocessor 48 then moves to a decision state 222 where it decides whether all of the thirty two discard strategies have been processed by the microprocessor according to the state 220. If the microprocessor 48 finds that not all the discard strategies have been so calculated, it returns to the state 218 to perform the calculation of state 220 on the remaining discard strategies. Once all of the thirty two possible discard strategies have been so calculated, the microprocessor 48 moves to a state 224 where it selects the highest Expected Value calculated for all of the thirty two possible discard strategies from the summed Expected Values stored in the RAM array 42 along with the associated hold or discard strategy necessary to achieve this highest Expected Value.

The microprocessor 48 then moves to a state 226 where it builds a message for the central processing unit 12 indicating what is the highest Expected Value and what is the optimum hold or discard strategy. The optimum hold or discard strategy is, of course, the strategy indicating which of the five cards should be held and which should be discarded that will generate the highest Expected Value.

The microprocessor 48, then moves to a state 228 where it sends the message via the UART 32, the communication 30, and the communication link 26 to the central processing unit 12 of the video poker game 6. In the state 228, the microprocessor 48 also reloads a response timer with a preselected number in case the sent message does not get through to the central processing unit 12. The response timer is similar to the timer used in conjunction with the central processing unit 12 in that it counts down to zero.

The microprocessor 48 then moves to a decision state 230 where it checks to see if the timer is at zero. If the timer is at zero the microprocessor 48 will move to a state 232 where it will increment a retry counter. The retry counter is initialized at zero each time the video poker game 6 enters the state 104 (FIG. 4). The microprocessor 48 then moves to a decision state 234 where it compares the retry counter to a pre-selected maximum number of permissible retries. If it finds that the retry counter is equal to, or exceeds the maximum number of permissible retries it returns to the state 202.

If, in the state 230, the microprocessor 48 finds that the time is not equal to zero, it then moves to a decision state 236 where it checks to see if it has received a negative acknowledgement signal (NACK) from the central processing unit 12 indicating that the central processing unit 12 has not received the correct message. As discussed above, the central processing unit 12 will generate a NACK signal in the state 134 shown in FIG. 4. If the microprocessor 48 decides in the decision state 236 that it has received a NACK signal from the central processing unit 12, it then goes to the increment retry counter state 232. If the microprocessor 48 decides that it has not received a NACK signal from the central processing unit 12, it then proceeds to a decision state 238. In the decision state 238, the microprocessor 48 determines whether it has received a valid acknowledgement signal (ACK) from the central processing unit 12. As discussed previously, a valid ACK signal will be generated by the central processing unit 12 when it is in the state 138 shown in FIG. 4. If the microprocessor 48 determines that a valid ACK signal has been received from the central processing unit 12 it then returns to the start state 100. If the microprocessor 48 determines that a valid ACK signal has not been received from the central processing unit 12, it then returns to the decision state 230 to determine whether the timer has run to zero.

The states 230 though 238 ensure that the message sent by the microprocessor 48 to the central processing unit 12 in state 228 was correctly transmitted without any errors induced by the communication process. These states require that the message be acknowledged by the central processing unit 12 within a set time or the microprocessor will resend the message. If no acknowledgement signal is received after successive retries, the microprocessor 48 returns to the receive request state 202.

As can be appreciated the ACK/NACK protocol described in this embodiment is designed to ensure that the data transmitted between the central processing unit 12 and the module 28 in both directions is transmitted and received without any induced errors to the intended recipient. As can further be appreciated, any number of serial communication protocols can be used to ensure accurate transmission and the signals can be transmitted on any of a number of electrical signal standards e.g. RS-232, RS-422, RS-485 etc.

To further illustrate how expected values will be calculated in the above described preferred embodiment for a five card video poker hand, the calculation will now be described in relation to the following sample five card hand in which the player has received a Jack of Hearts, a Ten of Hearts, a King of Hearts, an Ace of Hearts, and a Two of Diamonds.

As previously stated, there are 32 discard scenarios which could be used in playing this hand and to determine the optimum play strategy, the strategy which would provide the highest expected value of awards to the player the expected value of all 32 possible discards scenarios would be computed using formula (1). A single discard scenario, discarding the Two of Diamonds will be used in Table 2 to illustrate the details of the Expected Value calculation for a single discard scenario.

TABLE 2

| Possible Winning Hands | Ways to Attain Winning Hand N | Probability of Occurrence $P(A_n)$ | Award $A_n$ | Intermediate Term $A_n * P(A_n)$ |
|---|---|---|---|---|
| Royal Flush | 1 | 1 in 47 | 800 | 17.0213 |
| Pair of Kings | 3 | 3 in 47 | 1 | .0638 |
| Pair of Jacks | 3 | 3 in 47 | 1 | .0638 |
| Pair of Aces | 3 | 3 in 47 | 1 | .0638 |
| 10 through Ace Straight | 3 | 3 in 47 | 4 | .2553 |
| Flush | 8 | 8 in 47 | 5 | .8511 |

In state 220, the microprocessor 48 will first determine the number of ways to attain each of the winning hands listed in the pay schedule supplied by the central processing unit 12 (shown in column 2 of Table 2 above). The microprocessor 48 will then calculate the probability that the player will receive the cards needed to achieve the winning combination $P(A_n)$ (shown in column 3 of Table 2 above). Then the microprocessor 48 will multiply the probability of occurrence $P(A_n)$ of a specific award times the award value for that specific award $A_n$ (shown in column 4 of Table 2 above) to obtain the intermediate term $A_n * P(A_n)$ which represents the expected value that a particular hand, using a particular discard strategy, has for that particular winning combination. The microprocessor 48 then sums all of the intermediate terms to achieve the total Expected Value for that hand using that particular discard strategy. For example, the only way to win a Royal Flush is by drawing the Queen of Hearts. Since there are 47 cards remaining in the deck, the odds of drawing the Queen of Hearts in a randomly distributed deck are 1 in 47. Multiplying this probability times the 800 unit award yields the intermediate term 17.0213. Similarly, a pair of Kings can be won by drawing one of the three remaining Kings in the 47 cards. Hence, the odds of drawing one of the three remaining Kings is 3 in 47. Multiplying this probability times the one unit award yields the intermediate term of 0.0638. As can be appreciated, the odds of drawing pair of Jacks or Aces is the same as the odds of drawing a pair of Kings, 3 in 47 and the intermediate term will be the same as well since the award values are also one unit. There are four possible ways to attain a 10 through Ace Straight, by drawing one of the four Queens remaining in the deck. However, drawing the Queen of Hearts will result in the Royal Flush whose odds were calculated above, hence the odds of pulling a 10 through Ace straight which is not a Royal Flush are 3 in 47. Multiplying this probability times the five unit award yields the intermediate term of 0.8511. Finally, there is a total of nine remaining cards within the deck that will give the player a Flush of hearts as there are 13 total Heart cards and the player already has four of them. Thus, the odds of drawing a Flush of Hearts is 9 in 47. Multiplying this probability times the five unit award yields the intermediate term of 0.8511.

Finally, the microprocessor 48 in the state 220 will sum all of the intermediate terms to determine what the expected value of this hand is with the one of thirty two possible play strategies where the player discards the Two of Diamonds and receives one additional card. In this case the sum of the expected values $\Sigma A_n * P(A_n)$ for this discard scenario is equal to 18.3191. If this was the highest possible discard scenario for this hand of cards, it would be returned to the central processing unit 12 from the module 28 in state 228 and would be used to calculate the stop play award for this hand by the central processing unit 12 in the states 140 through 154. As can be appreciated, Table 2 does not include any three or four of a kind winning combinations as the single card discard strategy used here precludes the player from obtaining the winning combination.

The above described embodiment contemplates that there be a separate module 28 calculating the Expected Value for the video poker game. However, a person reasonably skilled in the art can appreciate that if the central processing unit 12 is sufficiently fast and there is sufficient storage e.g. RAM and EPROM storage, then the calculation of the Expected Value can be done within the central processing unit 12 thereby minimizing the need for the protocols ensuring accurate data transmission between different components.

As can be further appreciated by a person skilled in the art, Applicant's invention can be expanded to many other games and gaming machines. The above described embodiments have been limited to offering a "stop play" award in games having a single mid-round decision phase, after a single round of play. However, a person skilled in the art can appreciate that more than one "stop play" award may be offered the player, in games with more than one mid-round decision phase e.g., after each successive element is given, or even after each successive card is dealt in poker prior to the final combination of elements being achieved. Further, if these "stop play" awards are calculated based on the Expected Value as calculated by formula (1), multiple "stop play" award offers will have no effect on the overall game hold and payback percentages.

Further, in another preferred embodiment, the above described invention can be modified to existing games which do not have mid round decision phases. A simple example of this would be a slot machine. In typical slot machines players place a wager and then activate the reel spin mechanism which randomly positions one or more reels indexed with various symbols. These reels can be either physical or virtual, i.e. index positions are maintained in the memory of a central game controller. Final alignment of the index symbols when the reel stop is used to determine the final award amount. The only decision phase occurs when the player initially wagers. The game could be modified such that after each reel stops spinning, a stop play offer would be made while the remaining reels continue to spin. This stop play offer could also be based upon a calculation of the expected value of the final award given the position of the reels which have already stopped.

Although the above detailed description has shown, described and pointed out fundamental novel features of the invention as applied to the various embodiments discussed above, it will be understood that various omissions and substitutions and changes in the form and details of the device illustrated may be made by those skilled in the art, without departing from the spirit of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A player interactive gaming system comprising:

a selected number of elements each having identifying characteristics, wherein certain combinations of said elements are defined to be winning combinations;

an element assigning system, having access to said selected number of elements and receiving player input signals, which assigns and displays to said player a plurality of said elements;

a stop play award system responsive to the identifying characteristics of at least one element assigned to said player for establishing a stop play award prior to said player being assigned a final one of said elements wherein the value of said stop play award is based at least in part on the probability that said at least one element will, in combination with another of said selected number of elements, comprise one or more of said winning combinations;

a final award system responsive to the identifying characteristics of the at least one element and the assignment of the final one of said elements for establishing a final award; and an award distribution system responsive to the stop play award system, the final award system and player input signals, for distributing to said player the winning final award when the elements assigned to the player include said final one of said elements and when the combination of elements assigned to the player includes at least one of said winning combinations and for distributing to the player the stop play award when said distribution system receives a player input signal indicating said player has accepted said stop play award.

2. The player interactive gaming system of claim 1 wherein said selected number of elements are comprised of playing cards.

3. The player interactive gaming system of claim 2 wherein said winning combinations are defined as winning poker card combinations including a pair, two pairs, three of a kind, a full house, a straight, a flush and a royal flush.

4. The player interactive gaming system of claim 1 wherein the selected number of elements are comprised of numbers.

5. The player interactive gaming system of claim 4 further comprising a mechanism which defines at least one set of numbers to be said winning combination prior to said stop play award system offering said player said stop play award.

6. The player interactive gaming system of claim 1 wherein:

the selected number of elements comprise a plurality of markings on a plurality of spinning reels;

the element assigning system comprises a mechanism for sequentially stopping said plurality of spinning reels;

the assigned at least one element comprises the positions of said markings on said reel when said reel is stopped; and the elements assigned to the player which include the final one of said elements comprise those markings on the plurality of reels that lie in a selected portion of said reels when all of the reels have been stopped.

7. The player interactive gaming system of claim 1 wherein a player input signal indicating said player has accepted said stop play award prevents said award distributing system from distributing any of said final awards.

8. The player interactive gaming system of claim 1 wherein said element assigning system sequentially assigns and displays elements to said player in response to a first player input signal.

9. The player interactive gaming system of claim 8 wherein said first player input signal is produced in response to a wager by said player.

10. The player interactive gaming system of claim 9 wherein the value of said stop play award is proportional to an expected value of said at least one element assigned to said player when said stop play offer is made, said expected value being established by said stop play award system according to the following formula:

$$\text{Expected Value} = \sum_{n=1}^{N} A_n * P(A_n)$$

where $A_n$ is the winning combination award amount paid for a nth winning combination, $P(A_n)$ is the mathematical probability that given the elements said player has been assigned when said stop play offer is made, said player will be assigned a fixed portion of said elements containing said nth winning combination, and N is the total number of said winning combinations that can be attained by said player given the elements said player has been assigned when said stop play offer is made.

11. A player interactive gaming system comprising:

assignment means for assigning a portion of a selected number of elements having identifying characteristics to said player, wherein certain combinations of said elements are defined to be winning combinations;

interrupt means for interrupting said assignment of elements, after said player has received a first number of elements and offering said player a stop play award based on said first number of elements wherein the value of said stop play award is based at least in part on the probability that said at least one element will, in combination with another of said selected number of elements, comprise one or more of said winning combinations;

selection means for enabling said player to accept or reject said stop play offer, wherein player acceptance of said stop play award offer results in said player receiving said stop play award, and player rejection of said stop play award results in continued assignment of elements; and award distribution means for providing the stop play award to said player in response to an indication from the selection means of player acceptance of the stop play offer, and for providing a winning combination award based on winning combinations of said elements contained within the elements assigned to the player.

12. The player interactive gaming system of claim 11 wherein said selected number of elements comprise cards, and a said assignment means comprises a dealer.

13. The player interactive gaming system of claim 11 further comprising an expected value calculation means for calculating a value upon which the stop play award is based, said expected value being calculated by the following formula:

$$\text{Expected Value} = \sum_{n=1}^{N} A_n * P(A_n)$$

where $A_n$ is the award amount paid for a nth winning combination, $P(A_n)$ is the mathematical probability, given said first number of elements assigned to said player, that said player will receive a fixed portion containing said nth winning combination, and N is the total number of said winning combinations that can be attained by said player with said first number of elements.

14. The player interactive gaming system of claim 13 wherein said stop play award size is base at least in part on said value calculated by said expected value calculation means.

15. The player interactive gaming system of claim 14 wherein said stop play award is proportional to said expected value.

16. The player interactive gaming system of claim 15 further comprising a means for selectively changing the degree to which said stop play award is proportional to said expected value.

17. The player interactive gaming system of claim 11 wherein said selected number of elements comprise electronic signals representative of said assigned elements and said assignment means includes a first central processing unit connected to a video display for displaying to said player said assigned elements.

18. The player interactive gaming system of claim 17 wherein said interrupt means and said award distribution means are an integral part of said first central processing unit, and said selection means provides inputs to said first central processing unit.

19. The player interactive gaming system of claim 18 wherein said expected value calculation means includes a second central processing unit which provides inputs to said first central processing unit indicative of said expected value.

20. A player interactive gaming system comprising:

assignment means for assigning to the player a first number of elements selected from a greater number of elements having identifying characteristics wherein certain combinations of said elements are defined to be winning combinations;

means for determining a first stop play award based upon the first number of elements wherein the value of said stop play award is based at least in part on the probability that said at least one element will, in combination with another of said selected number of elements, comprise one or more of said winning combinations;

means for offering the first stop play award to the player;

means responsive to player inputs for assigning additional elements to the player;

means for determining a final award based upon winning combinations of elements assigned to the player; and award means responsive to the means for determining a stop play award and to the means for determining a final award for providing one of said awards to said player.

21. The player interactive gaming system of claim 20 wherein the elements comprise cards and wherein the assignment means comprises a dealer.

22. The player interactive gaming system of claim 21 further comprising an expected value calculation means for determining an expected value of said first number of elements.

23. The player interactive gaming system of claim 22 wherein said expected value calculation means includes a table containing the expected values for the possible combinations of the first number of elements.

24. The player interactive gaming system of claim 23 wherein said stop play award determining means receives said expected value from said expected value calculation means and thereby produces a first stop play award amount based at least in part on said expected value.

25. The player interactive gaming system of claim 22 wherein said expected value for said first number of elements is calculated by said expected value calculation means according to the following formula:

$$\text{Expected Value} = \sum_{n=1}^{N} A_n * P(A_n)$$

where $A_n$ is the award amount paid for a nth winning combination, $P(A_n)$ is the mathematical probability, given said first number of elements assigned to said player, that said player will be assigned said additional elements so that the combination of said first number of elements and said additional elements contains said nth winning combinations and N is the total number of said winning combinations that can be attained by said player with said first number of elements.

26. The player interactive gaming system of claim 25 wherein said determining means receives said expected value from said expected value calculation means and thereby produces a first stop play award amount proportional to said expected value.

27. The player interactive gaming system of claim 26 wherein said greater number of elements comprise electronic signals representative of said assigned elements, and wherein said assignment means includes a first central processing unit connected to a video display for displaying to said player said assigned elements.

28. The player interactive gaming system of claim 27 wherein said means for determining a first stop play award, said means responsive to player inputs and said means for determining a final award are an integral part of said first central processing unit.

29. The player interactive gaming system of claim 28 wherein said expected value calculation means includes a second central processing unit which provides inputs to said first central processing unit indicative of said expected value.

30. The player interactive gaming system of claim 28 wherein said first central processing unit further includes a means for permitting the degree of proportionality between said first stop play award amount and said expected value to be selectively changed.

31. The player interactive gaming system of claim 26 further comprising means for determining a second stop play award based upon a second number of elements.

32. The player interactive gaming system of claim 31 wherein said second stop play award is proportional to an expected value of said second number of elements.

33. The player interactive gaming system of claim 32 wherein said expected value of said second number of elements is calculated by said expected value calculation means according to the following formula:

$$\text{Expected Value} = \sum_{n=1}^{N} A_n * P(A_n)$$

where $A_n$ is the award amount paid for a nth winning combination, $P(A_n)$ is the mathematical probability, given said second number of elements assigned to said player, that said player will be assigned said additional elements so that the combination of said second number of elements and said additional elements contains said nth winning combinations and N is the total number of said winning combinations that can be attained by said player with said second number of elements.

34. The player interactive gaming system of claim 33 wherein the award means is further responsive to said means for determining said second stop play award.

35. A player interactive video draw poker game comprising:

a video screen;

a plurality of individual card signals representative of cards in a playing card deck, wherein certain combinations of said card signals are defined to be winning combinations;

a player input unit providing a plurality of player input signals in response to player manipulation of said input unit; and a central processing unit responsive to said plurality of card signals, connected to said video screen, and receiving said plurality of player input signals, wherein said central processing unit comprises:

means for assigning a first number of said card signals to said player and displaying on said video screen representations of said first number of card signals to said player in response to a first number of said player input signals;

means for generating a stop play award offer to be displayed to said player on said video screen in response to the contents of said first number of said card signals wherein the value of said stop play award is based at least in part on the probability that said first number of card signals will, in combination with another of said plurality of individual card signals, comprise one or more of said winning combinations;

means for signalling an award dispenser to dispense a stop play award in response to a second set of player input signals indicative of acceptance by said player of said stop play award offer;

means for replacing selected card signals assigned to said player with different card signals, thereby forming a second number of said card representative signals, and displaying on said video screen said second number of said card signals in response to a third set of player input signals; and means for signalling said award dispenser to dispense to said player a winning combination award when said second number of said card signals includes at least one of said winning combination of signals.

36. The video draw poker game of claim 35 wherein said winning combinations are defined to include a pair of aces, a pair of kings, a pair of queens, a pair of jacks, two pairs, three of a kind, a flush, a straight, four of a kind, and a royal flush.

37. The video draw poker game of claim 36 wherein said first number of said player input signals includes a wager.

38. The video draw poker game of claim 37 wherein said first number of said card signals and said second number of said card signals comprise five individual card signals wherein said player employs a selected discard strategy to replace up to five of said first number of said card signals to be assigned said second number of card signals.

39. The video draw poker game of claim 38 wherein said stop play award offer is based in part on an expected value of said first number of card signals.

40. The video draw poker game of claim 39 wherein said expected value is calculated according to the following formula:

$$\text{Expected Value} = \sum_{n=1}^{N} A_n * P(A_n)$$

where $A_n$ is the award amount paid for a nth winning combination, $P(A_n)$ is the mathematical probability, given said first number of said card signals assigned to said player, that said player will be assigned said second number of card signals containing said nth winning combination, and N is the total number of said winning combinations that can be attained by said player with said first number of card signals.

41. The video draw poker game of claim 40 wherein said expected value calculation is performed by a central processing unit based calculation module, and wherein said module calculates said expected value for all possible discard strategies, then signals to said central processing unit said highest expected value and said discard strategy achieving said highest expected value.

42. The video draw poker game of claim 41 wherein said central processing unit generates said stop play award offer based on said highest expected value and, in response to said second set of player inputs further displays to said player said discard strategy having said highest expected value.

43. The video draw poker game of claim 42 wherein said central processing unit implements said discard strategy having said highest expected value thereby replacing card signals of said first number of card signals with additional card signals plurality of card signals and displays to said player on said video screen the resulting card signals.

44. The video draw poker game of claim 43 further comprising a breakage means for truncating said stop play award to a nearest integer multiple of said wager amount, said remainder being stored in a breakage register.

45. The video draw poker game of claim 44 wherein the contents of said breakage register is selectively distributed to said players based on signals from said central processing unit.

46. A method of playing a game comprising the steps of assigning to a player a first number of elements selected from a second number of elements having identifying characteristics;

defining certain combinations of said elements to be winning combinations;

displaying said first number of elements assigned to said player;

determining a stop play award the value of which is based at least in part on the probability that said first number of elements will, in combination of at least one additional element of said second number of elements, comprise one or more of said winning combinations;

offering said player said stop play award;

assigning additional elements to said player in response to player inputs;

determining a final award based upon winning combinations of elements assigned to the player; and providing one of said determined awards to said player.

47. The method of playing a game according to claim 46 further comprising the steps of:

placing a wager by said player prior to said assigning of elements; and determining and distributing a second final award to said player if said player has accepted said stop play award and said assigned elements contain at least one of said winning combinations.

48. The method of playing a game according to claim 46 wherein said additional assigned elements are assigned to replace selected elements of said first number of elements.

49. The method of playing a game according to the claim 48 wherein the step of determining a stop play award comprises the steps of:

calculating in expected value of the first number of elements for each possible replacement of said first number of elements with said second number of elements using the following formula:

$$\text{Expected Value} = \sum_{n=1}^{N} A_n * P(A_n)$$

where $A_n$ is the award amount paid for a nth winning combination, $P(A_n)$ is the mathematical probability, given said first number of elements assigned to said player, that said player will receive elements containing said nth winning combination, and N is the total number of said winning combinations that can be attained by said player with said first number of elements; and determining the stop play award value as being proportional to the highest calculated expected value of each of the possible replacements of said first number of elements with said second number of elements.

50. The method of playing a game according to claim 46 wherein said elements are playing cards and said step of defining winning combinations comprises defining said winning combination of cards to be winning draw poker card combinations.

51. The method of playing a game according to claim 46 wherein said elements are spinning reels with markings and wherein:

the step of defining winning combinations comprises defining combinations of said markings that appear in a selected region adjacent said reels when said reels are at rest;

the step of assigning said first number of elements comprises stopping at least one of said spinning reels; and the step of assigning additional elements includes stopping at least another of said spinning reels.

52. The method of playing a game according to claim 46 wherein said elements comprise numbers and said step of defining winning combinations comprises substantially randomly selecting said numbers.

53. A method of playing poker with at least one deck of cards comprising the steps of:

defining certain combinations of cards to be winning combinations;

assigning and displaying to a player a first number of said cards in response to a first player signal;

offering said player a stop play award the value of which is based at least in part on the probability that said first number of cards will, in combination with one or more of cards of said deck of cards, comprise one or more of said winning combinations;

dispensing said stop play award to said player in response to a second player signal indicative of player acceptance of said offer;

assigning and displaying to said player a second number of said cards in response to a third player signal; and dispensing an award to said player if said cards assigned to said player include at least one of said winning combinations.

54. The method of playing poker as defined in claim 53 wherein said first player signal comprises the step of placing a wager.

55. The method of playing draw poker as defined in claim 53 wherein said first number of cards assigned to the player is five.

56. The method of playing poker as defined in claim 53 wherein said winning combinations include a pair, two pairs, three of a kind, four of a kind, a full house, a straight, a flush, a straight flush, and a royal flush.

57. The method of playing poker as defined in claim 53 wherein said step of assigning and displaying to said player said second number of said cards in response to said third player signal comprises replacing cards selected by said player from said first number of cards with cards from said deck.

58. The method of playing poker as defined in claim 53 further comprising the step of calculating the amount of said stop play award based at least in part on an expected value of said first number of cards.

59. The method of playing poker as defined in claim 58 wherein the expected value is determined by reference to a table containing expected values of card combinations.

60. The method of playing poker of claim 58 wherein the stop play award is based at least in part on the highest expected value of said first number of cards calculated for all possible replacement strategies of said first number of cards according to the following formula:

$$\text{Expected Value} = \sum_{n=1}^{N} A_n * P(A_n)$$

where $A_n$ is the award amount paid for a nth winning combination, $P(A_n)$ is the mathematical probability, given said first number of cards assigned to said player, that said second number of cards will contain said nth winning combination, and N is the total number of said winning combinations that can be attained by said player with said first number of cards.

61. The method of playing poker as defined in claim 60 wherein said method is implemented on a video poker game comprising a video display screen and a central processing unit.

62. The method of playing poker as defined in claim 61 wherein said central processing unit assigns and displays said cards in the form of video signals representative of said cards displayed on said video screen.

* * * * *